United States Patent [19]

Lamle

[11] Patent Number: 4,570,940

[45] Date of Patent: Feb. 18, 1986

[54] OBVERSE/REVERSE DOMINO GAME SET

[76] Inventor: Stewart M. Lamle, 55 W. 86th St., New York, N.Y. 10024

[21] Appl. No.: 603,706

[22] Filed: Apr. 25, 1984

[51] Int. Cl.[4] ..... A63F 1/00
[52] U.S. Cl. ..... 273/296
[58] Field of Search ..... 273/296

[56] References Cited

U.S. PATENT DOCUMENTS

| | | | |
|---|---|---|---|
| 3,831,945 | 8/1974 | Scherini | 273/296 |
| 4,257,611 | 3/1981 | Schmitz | 273/296 X |
| 4,355,812 | 10/1982 | McCullough | 273/296 X |

OTHER PUBLICATIONS

"Lady Luck" by Warren Weaver, publ. by Anchor Books, Garden City, N.Y., copyright 1963, pp. 123–127.

*Primary Examiner*—Anton O. Oechsle
*Attorney, Agent, or Firm*—Brian L. Ribando

[57] ABSTRACT

A game set comprises a plurality of individual pieces of substantially the same size and proportion, wherein each of the pieces has playing indicia on two opposite sides thereof. The number of forms of indicia is equal to N, and the number of pieces in the set is equal to (N)(N+1)/2, and each piece in the game set displays an indicia combination on two opposite sides which is unique in the set.

3 Claims, 2 Drawing Figures

OBVERSE/REVERSE DOMINO GAME SET

BACKGROUND OF THE INVENTION

This invention relates to a set of tiles which may be used in playing a game.

Games which utilize tiles are well known in the art. Such games usually comprise tile sets having indicia on one face thereof which are used in combination with other tiles of the set. Because the tiles have indicia on only one side, the variety of games which may be played with such tiles is limited and there is no element of surprise or logical reasoning as exists when indicia appears on both sides of the tile. There is therefore a need in the art for a tile game set which avoids the above disadvantages.

SUMMARY AND OBJECTS OF THE INVENTION

According to the invention, a tile game set is provided wherein the individual tiles comprising the set display indicia on both sides thereof. Such tiles are usable in a variety of tile games which provide both enjoyment and a challenge for the game players.

It is, therefore, an object of the invention to provide a tile game set comprising tiles which have indicia on both faces thereof.

Other objects of the invention will become apparent from the following detailed description taken in conjunction with the accompanying drawing figures in which reference numerals used throughout the description designate like or corresponding parts throughout the drawings.

DESCRIPTION OF THE PREFERRED EMBODIMENT

Figure 1:
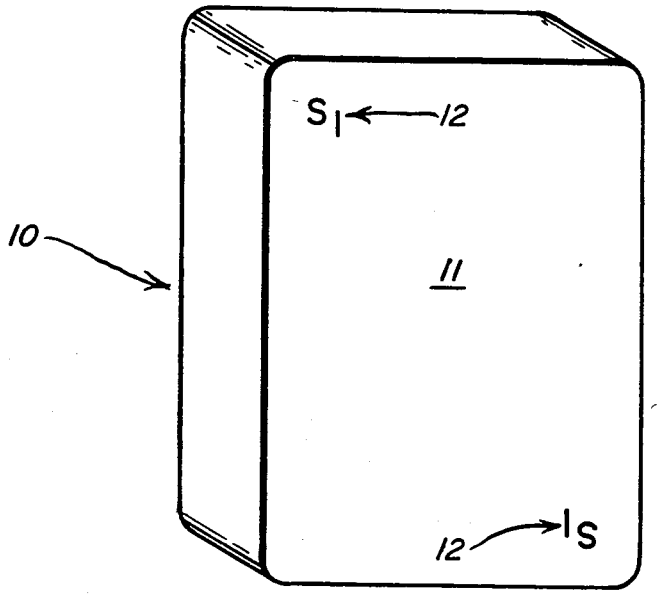
FIG. 1 shows the front face of a typical tile in the tile game set of the invention.

Referring now to the drawing figures, there is shown in FIG. 1 a tile 10 according to the instant invention. The tile 10 is generally square in shape and is formed of a material such as plastic, wood, stone, cardboard or the like. The tiles have a smooth surface and may be stained or painted, or left in a natural state as desired. The tile 10 comprises a front side 11 and the upper left- and the lower right-hand corner of each tile includes marking indicia 12. Such indicia 12 may comprise numbers, letters, symbols, or colors which allow the tiles to be distinguished one from the other. In a preferred embodiment, the symbols used on the tiles are the numbers 0, 1, 2, 3, 4, 5, 6, 7, 8, 9, 10, 11, 12, and W (for Wild).

Figure 2:
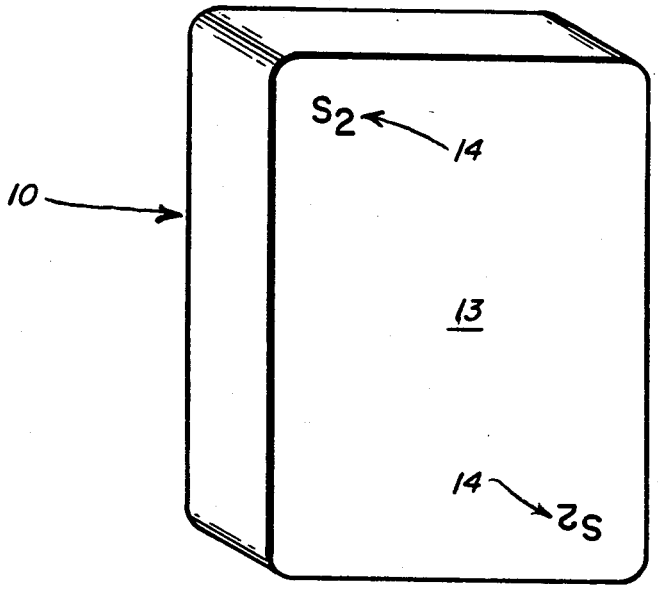
FIG. 2 shows the reverse side of the tile FIG. 1.

FIG. 2 shows the reverse side 13 of the tile FIG. 1. Indicia 14 appears on the reverse surface of the tile, and this is located on the upper left- and lower right-hand corner of the tile. The indicia 14 may also comprise numbers or letters or symbols or the like, but will be chosen from the same group of indicia comprising the indicia 12 on the front surface of the tile. Accordingly, in the preferred embodiment, the indicia 14 may comprise one of the following symbols: 0, 1, 2, 3, 4, 5, 6, 7, 8, 9, 10, 11, 12, and W (for Wild).

The indicia combinations on the front and the back surfaces of the tiles are chosen so that a tile set includes tiles having every combination of two indicia including those combinations where the two indicia are the same.

Accordingly, a tile set constructed according to the preferred embodiment will have N forms of indicia, in this case 14, and the total number of tiles in the set will be equal to $(N)(N+1)/2$, in this case $(14)(15)/2=105$ tiles.

0/0, 0/1, 0/2, 0/3, 0/4, 0/5, 0/6, 0/7, 0/8, 0/9, 0/10, 0/11, 0/12, 0/W, 1/1/, 1/2, 1/3, 1/4, 1/5, 1/6, 1/7, 1/8, 1/9, 1/10, 1/11, 1/12, 1/W, 2/2, 2/3, 2/4, 2/5, 2/6, 2/7, 2/8, 2/9, 2/10, 2/11, 2/12, 2/W, 3/3, 3/4, 3/5, 3/6, 3/7, 3/8, 3/9, 3/10, 3/11, 3/12, 3/W, 4/4, 4/5, 4/6, 4/7, 4/8, 4/9, 4/10, 4/11, 4/12, 4/W, 5/5, 5/6, 5/7, 5/8, 5/9, 5/10, 5/11, 5,12, 5/W, 6/6, 6/7, 6/8, 6/9, 6/10, 6/11, 6/12, 6/W, 7/7, 7/8, 7/9, 7/10, 7/11, 7/12, 7/W, 8/8, 8/9, 8/10, 8/11, 8/12, 8/W, 9/9, 9/10, 9/11, 9/12, 9/W, 10/10, 10/11, 10/12, 10/W, 11/11, 11/12, 11/W, 12/12, 12/W, W/W.

MODE OF USE OF THE PREFERRED EMBODIMENT

The tiles are placed in a sack and seven are chosen by each player. The players show only one side of their tiles to the other players. The player with the highest tile on which the indicia on both sides is the same goes first. Other players follow in turn. If there are no tiles in which two sides are the same, then the player with the highest valued tile, counting both sides, plays that tile first on the table with the highest side down. In turn each player shows that side of the tile that matches the showing face of the exposed tile, and;

(a) if that tile does not have identical indicia on both the obverse and reverse sides, with only one side matching the face-up side of the tile on the table, it is placed so that it abuts the short end of the tile already played showing the dissimilar face up; thus, the next player has two tiles which may be matched. The tile that has been placed may be placed in line or at right angles to the previous tile; or (b) if the tile has two sides which are identical and matching the tile on the table, that tile is shown to the other players and is placed perpendicularly to that tile such that two ends of the new tile are exposed and open for play.

The play continues around the table until a player does not have a tile in which either side matches any open tile ends on the table. That player must then choose tiles from the sack until one is found which matches an open end. The player may, for strategic reasons (for example to prevent someone who has a single exposed tile with the same number as that picked from going out and winning the game) choose to continue picking tiles until he can make another match. Play continues until one of the players no longer has any tiles. That person is the winner of the round. The winner counts the values of both sides of all the other players remaining tiles. The "0" to "12" tiles are counted at face value while the "Wild" tile counts as 15 points. That sum is the winning score for the round. The first player to reach 500 points is the winner of the game.

Having thus described the invention, various and modifications thereof will occur to those skilled in the art. For example, the playing elements are not to be limited to tiles but may take the form of blocks or cards. In each of these forms, the indicia appearing on opposite sides of the game pieces will be varied as described above, enabling similar type games to be played as with the preferred embodiment.

Other alterations and modifications of the described invention will occur to those skilled in the art, which modifications and alteration are intended to be within the scope of the invention as defined by the appended claims.

What I claim is:

1. A game set consisting of a plurality of individual pieces, each of said pieces having game playing indicia on first and second opposite sides thereof, wherein N forms of indicia are used on the pieces of the game set and N is equal to or greater than 3, wherein each piece displays an indicia combination which is unique in the game set, and wherein the total number of pieces in the set is equal to $(N)(N+1)/2$.

2. The game set of claim 1 wherein N pieces of the game set have the same indicia on both sides thereof.

3. The game set of claim 1 wherein N forms of indicia are used on the pieces of the game set and N pieces of the game set have the same indicia on both sides thereof.

* * * * *